United States Patent [19]

Jackson

[11] 4,074,652

[45] Feb. 21, 1978

[54] STEERING AND PROPULSION DEVICE FOR WATERCRAFT

[76] Inventor: William M. Jackson, 109 Hursey Ave., Pass Christian, Miss. 39571

[21] Appl. No.: 708,426

[22] Filed: July 26, 1976

[51] Int. Cl.[2] ..... B63H 5/14

[52] U.S. Cl. ..... 115/35; 60/222; 114/151; 115/16; 115/42; 415/68

[58] Field of Search ..... 115/35, 12 R, 14, 16, 115/42; 114/151; 415/66, 68, 209, 170 R; 60/222

[56] References Cited

U.S. PATENT DOCUMENTS

| | | | |
|---|---|---|---|
| 1,805,597 | 5/1931 | Pratt | 60/222 |
| 3,127,865 | 4/1964 | Pleuger | 115/16 X |
| 3,590,766 | 7/1971 | Jackson | 114/151 |

FOREIGN PATENT DOCUMENTS

| | | | |
|---|---|---|---|
| 1,367,472 | 12/1964 | France | 115/12 R |

*Primary Examiner*—Stephen G. Kunin
*Assistant Examiner*—Sherman D. Basinger
*Attorney, Agent, or Firm*—Watson, Cole, Grindle & Watson

[57] ABSTRACT

A two-stage axial flow steering and propulsion device has impellers operable by a right-angle reversible drive mounted on a watercraft, and a housing surrounds the blades of the impellers. The housing is mounted for rotation in opposite directions about an axis intersecting with and perpendicular to the blades' rotational axis. The device is therefore capable of a wide range of watercraft steering and propulsion maneuvers. A shroud structure in the form of a venturi-type ring surrounds each of the impellers thereby defining three separate pressure regions of positive pressure ahead of one of the impellers which pulls the fluid when rotating in one direction, a negative pressure between the impellers and a negative pressure behind the other impeller which pushes the fluid when rotating in such one direction.

8 Claims, 7 Drawing Figures

STEERING AND PROPULSION DEVICE FOR WATERCRAFT

BACKGROUND OF THE INVENTION

This invention relates generally to a two-stage axial flow steering and propulsion device for watercraft, and more particularly to such device mounted for rotation in opposite directions about an axis intersecting with and perpendicular to the rotational axis of the impellers.

Several approaches are known from the prior art in the steering or the steering and propelling of watercraft for effecting shifts in the path of movement thereof especially along a confined and narrow waterway. Hazardous conditions which are to be avoided, particularly for barges and other marine craft of appreciable length, are collisions with other watercraft, high winds affecting control of the watercraft and collision with dock facilities while maneuvering the watercraft into and out of confined dock locations. The range of maneuverability of such watercraft is, however, limited with the use of known steering devices, and the capacity of the steering devices for effectively moving large volumes of water therethrough, is likewise limited by the particular characteristics of such devices.

A prior art steering unit for barges and the like is disclosed in U.S. Pat. No. 3,590,766, wherein the steering unit is fixedly mounted on a barge and has a two-stage axial flow impeller unit rotatably mounted within a tube for conveying water therethrough. A one-stage axial flow pump disclosed by U.S. Pat. No. 2,847,941 characterizes the improved pumping capacity of the two-stage steering unit of the U.S. Pat. No. 3,590,766. And a marine craft steering unit is disclosed in U.S. Pat. No. 3,850,132 as including a "bowl hull" having a pair of the U.S. Pat. No. 3,950,766 propulsion devices on opposite sides of the vertical rotational axis to effect propulsion of the hull and the connected barge upon actuation of the devices, rotation of the hull being carried out by actuation of one of the off-center devices.

Propulsion and/or steering devices as aforementioned are, however, limiting in their steering capability since they are basically non-rotatable about an axis extending through the impeller rotational axis, and the pumping capacity through the devices is limited because of their particular design.

A propulsion device for driving and controlling watercraft is disclosed in U.S. Pat. No. 3,893,405 as including a downwardly opening bell-shaped shield fixed to a hull, vertical baffle plates on the shield defining exit passageways for alignment with a centrally mounted pump having impeller blades rotatable about a vertical axis. The exit opening of the pump is aligned with one of the shield passageways for steering the watercraft, upon rotation of the pump. With such an arrangement, however, the propulsion device has a tendency to draw the watercraft down into the water since a vertical suction effect is produced. An alignment of the impeller nozzle with one of the shield passageways is basically ineffective and impractical in steering the watercraft because of the low pumping capacity made possible by such an arrangement.

SUMMARY OF THE INVENTION

An object of the present invention is to provide a steering and propulsion device for watercraft as having a wide range of watercraft steering maneuverability, the device having a high pumping capacity and being highly efficient in its operation, while being simple and economical in its construction and easy to operate.

In carrying out this objective, such device is provided in the form of a two-stage axial flow nozzle wherein the impellers are driven by a right-angle drive from the watercraft and the nozzle is mounted for rotation about an axis perpendicular to and intersecting with the rotational axis of the impellers. A venturi-type ring surrounds each of the impellers to define three separate pressure regions of positive pressure ahead of one of the impellers which pulls the fluid when rotating in one direction, a negative pressure between the impellers and a negative pressure behind the other of the impellers which pushes the fluid when rotating in such one direction. Fluid-deflecting baffles are provided not only between the impellers but outwardly thereof for deflecting the fluid to flow toward the impellers and through the nozzle housing when the impellers are rotating in the one or opposite directions. The impeller blades may have flat pitch faces directed outwardly of the nozzle tube for improving upon the pumping capacity thereof, and each venturi-type ring may have a completely flat inner peripheral surface. The tips of the impeller blades may be flat and parallel to each such flat surface with the width of each flat surface being at least two-thirds less than the width of the tips of the blades. Each of the rings may also be truncated in cross-section with its opposite side walls converging inwardly, or the rings may have side walls rounded into a radius substantially equal to the thickness of each ring.

Other objects, advantages and novel features of the invention will become more apparent from the detailed description of the invention.

DETAILED DESCRIPTION OF THE INVENTION

Figure 1:
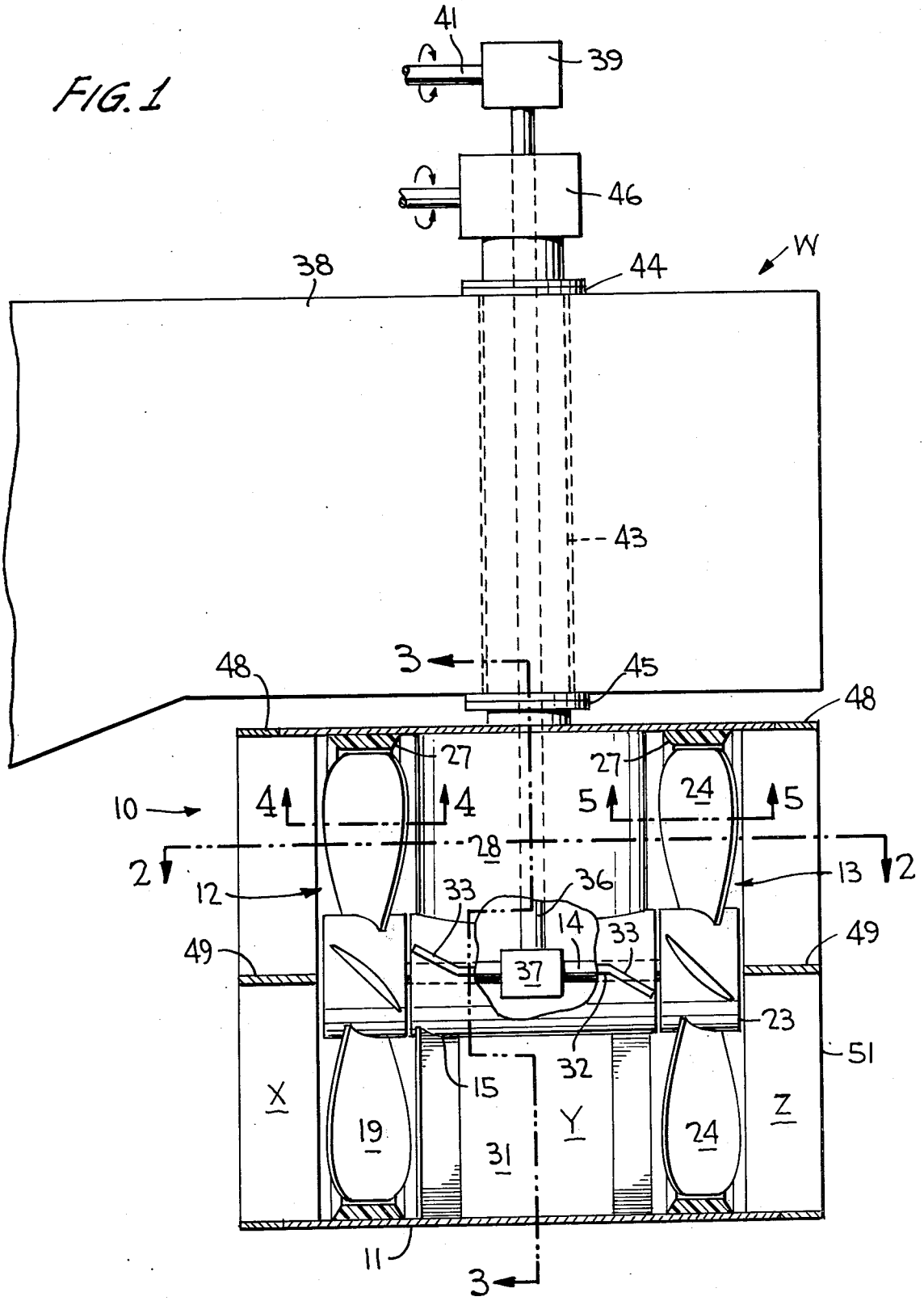
FIG. 1 is a side elevational view of the device according to the invention, partly in section, and shown rotatably mounted on a watercraft.
Figure 2:
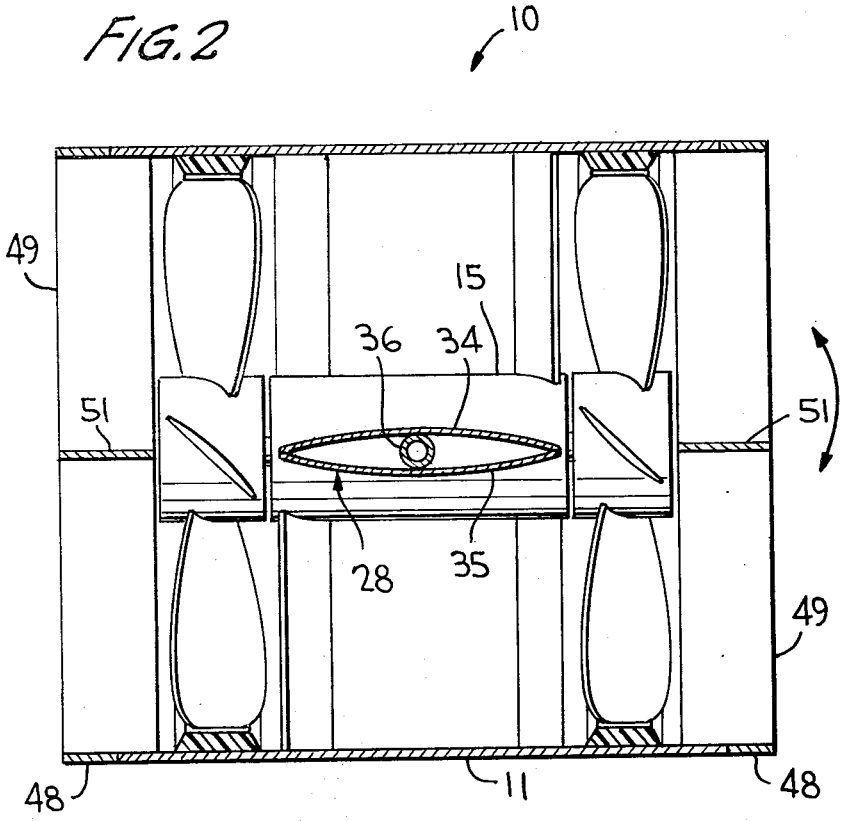
FIGS. 2 and 3 are sectional views of the device taken substantially along lines 2—2 and 3—3, respectively, of FIG. 1.
Figure 3:
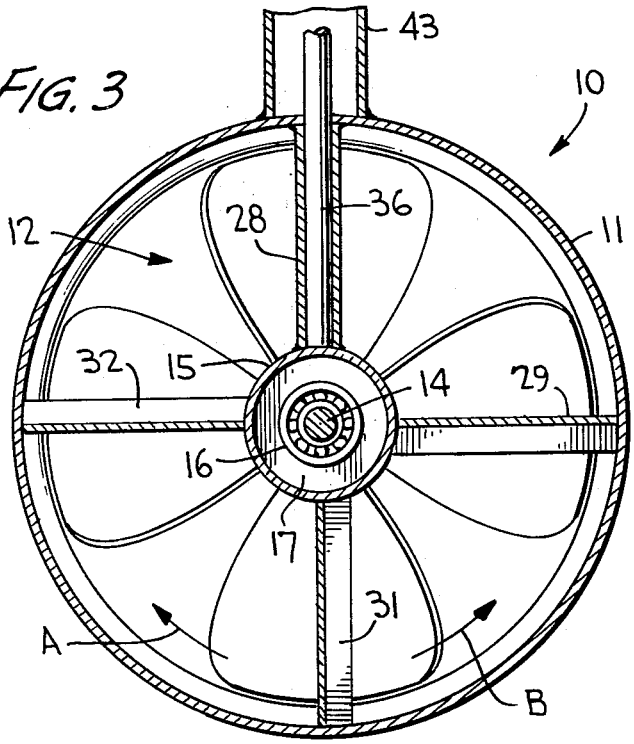

Turning now to the drawings wherein like reference characters refer to like and corresponding parts throughout the several views, the two-stage axial fluid flow steering and propulsion devise is generally shown at 10 in FIGS. 1 to 3 as being mounted on some suitable portion of watercraft W of FIG. 1. The device includes an annular housing or tube 11 forming a right circular cylinder having open ends with spaced impellers 12 and 13 rotatably mounted therein. The impellers are mounted at opposite ends of an impeller shaft 14 for rotation therewith, and are supported for rotation within a gear box 15 by means of bearings 16 mounted on end plates 17 (only one of each shown in FIG. 3) within the gear box.

Figure 4:
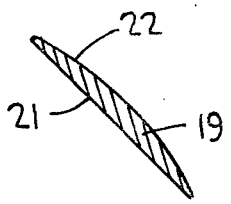
FIGS. 4 and 5 are cross-sectional views of the impeller blades taken substantially along lines 4—4 and 5—5, respectively, of FIG. 1.

Impeller 12 includes a hub 18 keyed to shaft 14 for rotation therewith, radially extending blades 19 being mounted on this hub. The pitch face 21 of each blade (see FIG. 4) may be flat and may be directed outwardly of tube 11, while the back face 22 of each blade may be curved.

Figure 5:
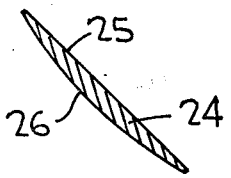

Impeller 13 is similar to that of impeller 15 in that it includes a hub 23 keyed to shaft 14 for rotation therewith, radially extending blades 24 being mounted on this hub. As shown in FIG. 5, the pitch face 25 of each blade 24 may be flat and may face outwardly of tube 11, while back face 26 of each blade 24 may be curved.

A shroud structure in the form of a venturi-type ring 27 surrounds the blades of each of the impellers to thereby define three separate pressure regions X, Y and Z. As shaft 14 rotates in the direction of arrow A, shown in FIG. 3, impeller 13 functions to push fluid out through tube 11 at a faster rate than impeller 12 is capable of pulling it therethrough because of the greater quantity of fluid ahead of impeller 12 as compared to that existing between the impellers. Accordingly, a positive pressure region X is defined ahead of impeller 12, a negative pressure region Y is formed between the impellers and a negative pressure region Z is defined behind impeller 13.

To facilitate movement of the water between the impellers while at the same time supporting box 15, radially extending fluid deflecting baffles 28, 29, 31 and 32 are provided between the gear box and the inner wall of housing 11. Baffles 29, 31 and 32 may be bent laterally as at 33 shown in FIG. 1 adjacent the back faces of impellers 12 and 13 in such a direction as to direct the flow of fluid toward the pitch faces of the impeller blades. The entire widthwise extent of these baffles may, alternatively, be disposed in this lateral direction, and the number of baffles may be varied, if desired, from that shown.

Baffle 28 is of a hollow construction having concave walls 34 and 35 joined along their opposite sides. A drive shaft 36 is engaged with impeller shaft 14 through a right-angle drive 37 which may be a bevel gear arrangement, or a worm gear arrangement (not shown). Shaft 36 is disposed within the space between walls 34 and 35 and extends outwardly through the wall of housing 11. The drive shaft therefore does not interfere with the fluid flow between the impellers since concave walls 34 and 35 of baffle 28 function to divert fluid around the drive shaft. Also, the drive shaft extends through a deck 38 or some suitable alternative support portion of the watercraft and is engaged through another rightangle drive 39 with a drive motor which includes a reversible gear. Shaft 36 may therefore be rotated in either direction about its axis so as to effect rotation of the impellers in either of opposite directions shown by arrows A and B in FIG. 3.

Surrounding drive shaft 36 is a hollow shaft 43 extending upwardly of deck 38 at one end and being mounted at its other end to housing 11 for the support thereof on the watercraft. The central axis of this hollow shaft intersects with the axis of impeller shaft 14 and is disposed perpendicularly thereto. Hence, housing 11 is essentially supported for rotation about a vertical axis passing through its central axis. Bearing and support collars 44 and 45 may be provided for the hollow shaft, and shaft 43 may be rotated about its central axis through an angular drive 46 as, for example, a worm gearing or a bevel gearing (not shown), operated by a motor, which may be an electric or hydraulic motor. A reversing gear is provided for the motor so as to effect rotation of hollow shaft 43 in the direction of the double arrow shown in FIG. 1 to thereby effect rotation of housing 11 in the direction of the double arrow shown in FIG. 2 around the central axis of the hollow shaft.

Rings 48 having baffle plates 49, 51 connected thereto are mounted on opposite ends of housing 11 with the baffle plates 49 and 51 extending inwardly adjacent the blades of the two impellers. These outer baffles give housing 11 a "purchase", i.e., the outer baffles in combination with their rings channel fluid toward the blades of the impellers, depending on the directions of arrows A and B of rotation, more effectively as compared to open ended tube 11 without such rings.

Figure 6:
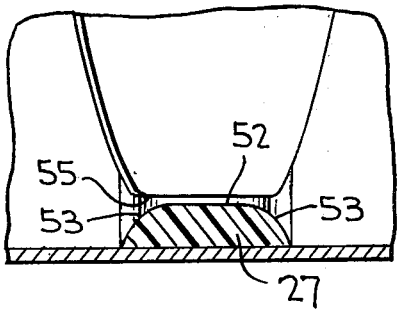
FIGS. 6 and 7 are slightly enlarged detail views, partly in section, showing the different embodiments for the rings or shroud structure surrounding each impeller.
Figure 7:
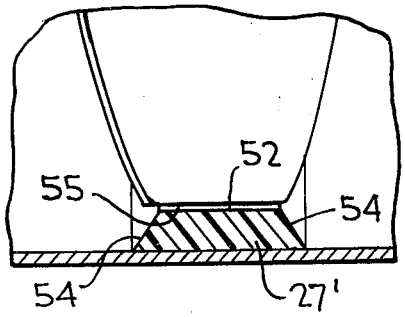

Each of the venturi-type rings 27 has a completely flat inner peripheral surface 52, as clearly seen in FIGS. 6 and 7 of the drawings. And each ring, which may be of a suitable elastomeric or metallic material, such as steel, may have opposite side walls 53 rounded into a radius substantially equal to the thickness of ring 27. Otherwise, each shroud structure may be in the form of a ring 27' which, as seen in FIG. 7, is truncated in cross-section and has opposite side walls 54 converging inwardly toward its inner surface 52.

Moreover, the blade tips of each of the impeller blades are flat as at 55, and the width of flat surface 52 of the ring for each impeller is designed to be not less than two-thirds the width of flat tip 55. The shroud cross-section in accordance with the FIG. 6 embodiment produces a maximum abrupt increased pressure for th fluid as it passes over the upstream side wall 53 and thereafter along flat surface 52. On the other hand, a slower velocity of the fluid and a smoother flow with the resulting less acute change in direction of the fluid flow is effected by means of ring 27' shown in FIG. 7 wherein the fluid passes over the upstream side wall 54 and along flat surface 52.

In order to produce a maximum efficiency in the flow of fluid to the pump, the tips of the blades of each impeller extend outwardly at opposite ends thereof relative to flat surfaces 52 of the ring, as clearly shown in FIGS. 6 and 7.

From the foregoing it can be seen that a steering and propulsion device is so mounted for rotation as to facilitate a wide range in maneuvering the ship while at the same time producing a high capacity two-stage axial fluid flow device. The impellers may be constantly rotated in the direction of arrow A and, in order to effect reverse movement, the entire device 10 may merely be rotated about the central axis of shaft 43. Otherwise, the impellers can be rotated in the direction of arrow B without so rotating the device about the axis of shaft 43. And any combination of impeller rotation in one direction or the other coupled with rotation of the device produces an infinite variety of steering maneuvers for the watercraft.

Also, rotation of the impellers in the direction of arrow A effects a push of the fluid out through tube 11 by impeller 13 at a faster rate than impeller 12 is capable of pulling it therethrough, as aforedescribed. Conversely, with the impellers rotating in the direction of arrow B, impeller 13 now serves to pull the fluid through the tube while impeller 12 pushes it therethrough. In this reverse direction of rotation, the flat pitch faces 25 of blades 24 function in the same manner as the flat pitch faces 21 of blades 19 while the pump is operating in the forward direction. The same flow and pressure characteristics are therefore produced in either direction and, by reason of the three separate and distinct pressure regions, fluid may be pumped at a higher velocity through the tube as compared to any of the prior art axial flow pumps of this type. Rings 27 or 27' each create an exaggerated flow for a reduced fluid pressure through the pump.

Obviously, many modifications and variations of the present invention are made possible in the light of the above teachings. It is therefore to be understood that within the scope of the appended claims the invention may be practiced otherwise than as specifically described.

What is claimed is:

1. A two-stage axial fluid flow steering and propulsion device capable of being mounted on a water vessel, comprising, an impeller shaft, a pair of spaced impellers mounted on said shaft for rotation therewith, an annular housing surrounding said impellers and defining a tube through which fluid may flow upon rotation of said impellers, a shroud structure in the form of a venturi-type ring surrounding each of said impellers thereby defining three separate pressure regions of positive pressure ahead of one of said impellers which pulls the fluid when rotating in one direction, a negative pressure between said impellers and a negative pressure behind the other of said impellers which pushes the fluid when rotating in said one direction, radially extending fluid deflection baffles disposed outwardly of said impellers and extending outwardly of opposite ends of said annular housing for deflecting the fluid to flow toward said impellers and through said tube when said impellers are rotating in said one direction or in a direction opposite thereof, said housing being mounted for rotation about an axis intersecting with and perpendicular to the impeller shaft axis, impeller shaft rotation means including a drive shaft having an axis lying perpendicular to the axis of said impeller shaft, and means for rotating said housing, whereby the device is capable of a wide range of steering maneuvers during rotation of said housing.

2. The device according to claim 1, wherein other radially extending fluid deflector baffles are disposed between said impellers.

3. The device according to claim 2, wherein one of said other baffles comprises a pair of concave walls interconnected along opposite sides thereof lying parallel to said drive shaft axis thereby defining a space therebetween, said drive shaft extending through the space between said walls and outwardly of said housing.

4. The device according to claim 1, wherein each of said impellers have radially extending blades each with flat pitch faces directed outwardly of said tube.

5. The device according to claim 1, wherein said ring surrounding each said impeller has a completely flat inner peripheral surface.

6. The device according to claim 5, wherein each of said blades of each said impeller has a flat tip parallel to said flat surfaces of said respective rings, the width of said flat surfaces being not less than two-thirds the width of said flat tips of said respective blades.

7. The device according to claim 5, wherein each of said rings is truncated in cross-section with its opposite side walls converging inwardly toward its flat inner peripheral surface.

8. The device according to claim 5, wherein the opposite side walls of each said ring adjacent its flat surface are rounded into a radius substantially equal to the thickness of each said ring.

* * * * *